United States Patent [19]

Schmale et al.

[11] Patent Number: 4,959,957

[45] Date of Patent: Oct. 2, 1990

[54] HYDRAULIC ACTUATING UNIT, IN PARTICULAR FOR RAISING A LOAD, SUCH AS A HOSPITAL BED

[75] Inventors: Fred W. Schmale, Denekamp; Tone Oudelaar, Oldenzaal, both of Netherlands

[73] Assignee: Applied Power Inc., Milwaukee, Wis.

[21] Appl. No.: 368,036

[22] Filed: Jun. 19, 1989

[30] Foreign Application Priority Data

Jun. 28, 1988 [NL] Netherlands ..... 8801644

[51] Int. Cl.[5] ..... A61G 7/00

[52] U.S. Cl. ..... 60/413; 60/418; 5/63

[58] Field of Search ..... 60/385, 413, 417, 418, 60/481; 5/11, 63, 65

[56] References Cited

U.S. PATENT DOCUMENTS

| | | | |
|---|---|---|---|
| 3,886,848 | 6/1975 | Budecker et al. | 60/418 X |
| 4,285,198 | 8/1981 | Budecker | 60/418 |
| 4,567,894 | 2/1986 | Bergman | 60/418 X |
| 4,831,826 | 5/1989 | Belart et al. | 60/418 X |
| 4,894,988 | 1/1990 | Hoppenjans | 60/418 |

*Primary Examiner*—Carl D. Price
*Assistant Examiner*—George Kapsalas
*Attorney, Agent, or Firm*—Quarles & Brady

[57] ABSTRACT

A hydraulic actuating unit for raising a hospital bed includes a reservoir, a hydraulic piston cylinder device the cylinder of which has its ends connected to the reservoir through a supply conduit that contains a hydraulic plunger pump with suction and pressure valve means and through a return conduit which contains an orifice in a normally closed relief valve. A branch conduit leads to a hydraulic liquid accumulator from the supply conduit at a location between the cylinder and pressure valve means. A multiple pilot operated check valve of the differential type is provided in the branch conduit towards the accumulator. The largest and smallest end faces of the differential spool member are subject to the pressure in the branch conduit while the differential area of the spool member is subject to the pressure in a conduit which leads from the return conduit at a location between the orifice and the relief valve. The pressure in the branch conduit to the accumulator tends to cause the spool member and the check valve to open while the pressure in the return conduit tends to move the spool member into a closed position.

3 Claims, 2 Drawing Sheets

HYDRAULIC ACTUATING UNIT, IN PARTICULAR FOR RAISING A LOAD, SUCH AS A HOSPITAL BED

BACKGROUND OF THE INVENTION

The invention relates to a hydraulic actuating unit, and particularly to a hydraulic actuating unit for raising a load such as a hospital bed.

Hydraulic actuating units are known which comprise a reservoir for hydraulic fluid, a hydraulic piston cylinder device, the cylinder of which has its ends connected to the reservoir through a supply conduit containing a hydraulic plunger pump with suction and pressure valve means and through a return conduit containing an orifice and a normally closed relief valve. A branch conduit leads to a hydraulic liquid accumulator and connects to the supply conduit at a location between the cylinder and the pressure valve means. A check valve is provided in the supply conduit at a location between the branch conduit connection and the cylinder. A pressure dependent orifice is provided between the check valve and the branch conduit to the accumulator.

These known actuating units are known for use with vertically adjustable hospital beds. They have the advantage of being relatively inexpensive. For raising the bed up to the level of an operating table, for example, the pump (usually of the single plunger type) is manually or foot operated so that hydraulic fluid is intermittently supplied to the hydraulic cylinder. The accumulator operates as a hydraulic shock absorber and minimizes the shocks at the beginning and the end of each pressure stroke of the pump. The supply conduits extending from the branch conduit to the cylinder and the branch conduit are dimensioned relative to each other such that when actuating the unit, the accumulator will be filled up "with priority" through the branch conduit. Lowering of the bed takes place by causing the relief valve to open, usually by means of a foot actuator, so that the hydraulic fluid is permitted to flow from the space under the piston into the reservoir.

When there is an increase in the load while the pump is stationary, for example when a person is sitting down on the bed of the patient, the check valve will prevent the bed from being lowered and hydraulic fluid being expelled toward the accumulator. However, a disadvantage of these known hydraulic actuating units is apparent in the case of a decrease in the load, such as when a patient is being lifted from the bed. When this occurs, the accumulator will supply hydraulic fluid to the cylinder as a result of the decrease in the pressure in the system and thereby will cause an unintended and undesirable raising of the bed. A further disadvantage is that actuation of the relief valve when it is desired to lower the bed will cause the accumulator to completely discharge so that it has to be refilled in the process of the next raising procedure.

The present invention overcomes these disadvantages.

SUMMARY OF THE INVENTION

In accordance with the invention, a hydraulic actuator unit as described above also includes a multiple pilot operated check valve of the differential type located in the branch conduit towards the accumulator. The largest and smallest end faces of the differential spool member of the valve are subject to the pressure in the branch conduit, while the differential area of the spool member is subject to the pressure in a conduit that is branched off from the return conduit from the cylinder at a location between the orifice and the relief valve. The pressure in the branch conduit to the accumulator tends to cause the spool member, and thereby the check valve, to open whereas the pressure in the return conduit tends to move the spool member and the check valve into a closed position.

It is a principal object of the invention to provide an improved hydraulic actuating unit for raising a load in which a decrease in the load will not result in an unintentioned raising of the load.

It is another object of the invention to provide such a hydraulic actuating unit in which an accumulator is not discharged upon each lowering of the load.

The invention will be hereinafter further described by way of example with reference to the accompanying drawings.

DETAILED DESCRIPTION OF THE PREFERRED EMBODIMENT

Figure 1:
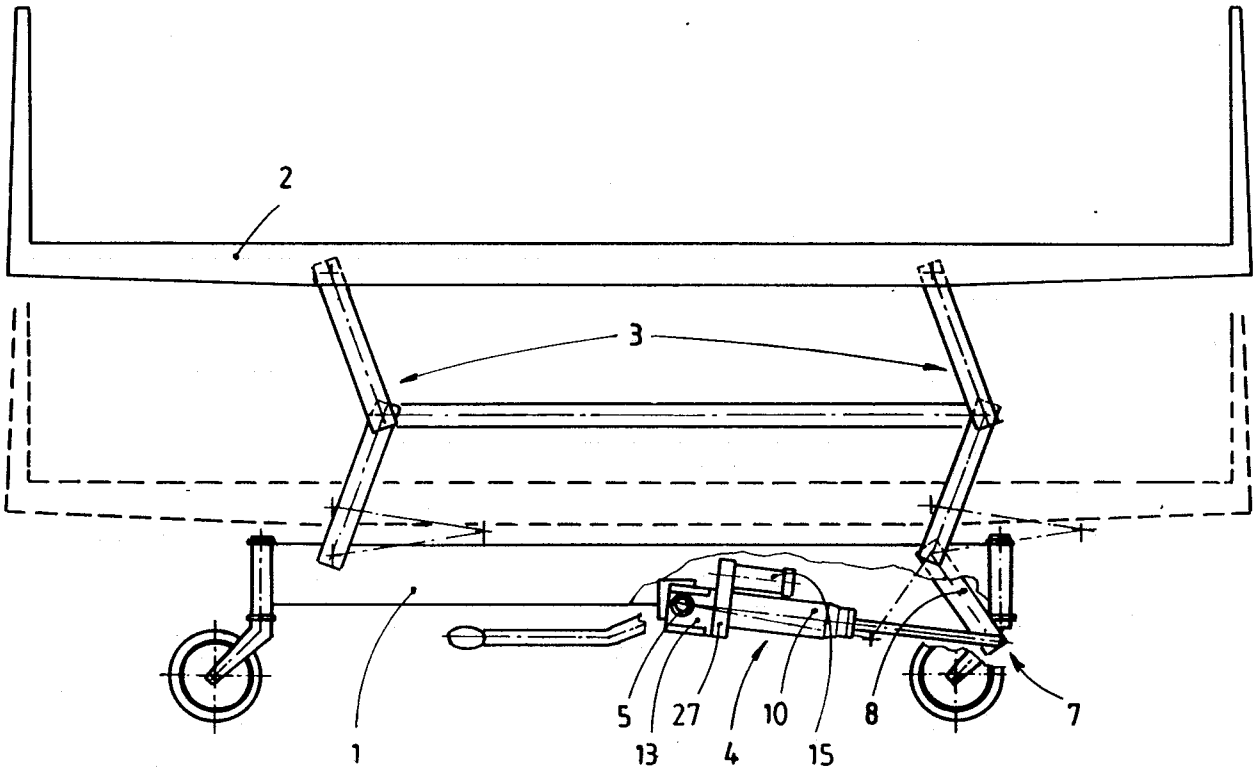
FIG. 1 is a diagrammatic side view of a hospital bed, having the actuating unit according to the invention incorporated therein.

The hospital bed shown in FIG. 1 comprises a wheeled undercarriage 1 on which a patient supporting section 2 is vertically adjustably supported by means of a linkage system 3. For lifting and lowering of the patient supporting section 2, a hydraulic actuating unit 4 is provided, which is pivotally connected to the undercarriage 1 at 5 and which has its free piston rod end connected to a lever 8 at 7. The lever 8 is rigidly coupled with the right-hand lever arms of the linkage system 3. In the drawing, the patient supporting section 2 is shown in its raised position in full lines, which position corresponds to the extended position of the piston of the actuating unit. The lowered position represented by broken lines corresponds to the retracted position of the piston of the actuating unit.

Figure 2:
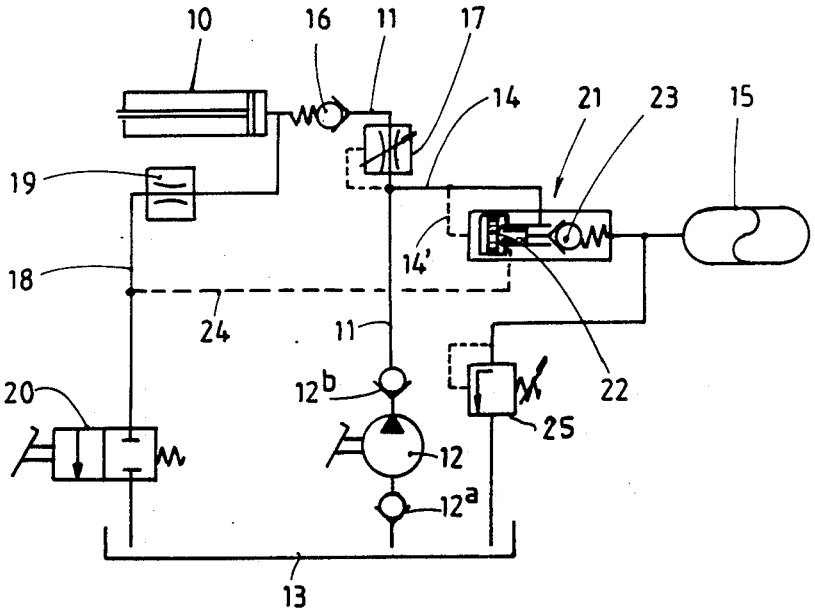
FIG. 2 is the hydraulic circuit diagram of the actuating unit according to the invention.

The actuating unit 4 will be hereinafter further described with reference to the diagram of FIG. 2.

In this hydraulic diagram, the piston-cylinder device 10 is connected to the pressure side of a hydraulic plunger pump 12 through a supply conduit 11, the suction side of the pump being connected to a reservoir 13 containing hydraulic fluid. A branch conduit 14 leads from the supply conduit 11 towards a hydraulic fluid accumulator 15. A check valve 16 and a pressure dependent flow valve 17 are provided in the supply conduit 11 between the piston-cylinder device 10 and the branch off location towards the accumulator 15. By means of the flow valve 17, the cross-sectional area of the supply conduit 11 will, as a response to an increase of pressure, be restricted to an extent that the ratio between the amounts of hydraulic fluid which is supplied at each pressure stroke of the pump towards the cylinder and the accumulator, respectively, will remain merely constant. As a consequence of this the extent of shock absorbing by the accumulator will be independent of the load.

An orifice 19 and a normally closed relief valve 20, which may be opened by hand or foot, are provided in a return conduit 18 leading from the cylinder 10 to the reservoir 13.

A multiple pilot operated check valve 21 is provided in the branch conduit 14 towards the accumulator 15. This check valve is of the different spool type. The largest operational surface of the differential spool 22 is subject to the pressure in the branch conduit 14 via the pilot control conduit 14' and the smallest surface of said spool 22 is also subject to the pressure in the branch conduit 14. The result of the two forces acting upon the two spool surfaces tends to move the differential spool 22 to the right to thereby cause the check valve 23 to open. A third pilot control conduit 24 is connected to the differential spool 22, and the third pilot control conduit 24 leads from the return conduit 18 at a location between the orifice 19 and the relief valve 20. This pilot control conduit 24 acts upon the annular spool surface between the largest and smallest spool surfaces. The pressure supplied through the pilot control conduit 24 produces a force which, in combination with the force acting upon the smallest spool surface, tends to move the spool 22 to the left to thereby cause the check valve 23 to close. An overload valve 25 is connected at a location between the valve 23 and the accumulator 15. The overload valve 25 opens if the supply pressure exceeds a certain level and allows hydraulic fluid to return to the reservoir 13. Thus this overload valve provides adequate protection against unacceptable high accumulator pressures.

The piston-cylinder device 10, the reservoir 13 and the accumulator 15 are integrated into a compact unit, making use of a common base portion 27. The base portion accommodates the various valves and conduits.

The actuating unit operates as follows:

In the starting situation, the accumulator pressure (e.g. the gas pressure above the liquid in the accumulator) is assumed to be lower than the supply pressure required to displace the piston of the piston-cylinder device.

When, in this situation, the pump 12 is actuated, the early pressure strokes will cause the accumulator to be filled to an extent that the accumulator pressure has reached the level required to overcome the piston load. Each time during a suction stroke of the pump hydraulic fluid will flow from the reservoir 13 via the opened suction valve **12*a* into the pumping chamber. During the subsequent pressure stroke, the fluid will flow to the accumulator via pressure valve 12*b*, branch conduit 14 and check valve 23**.

As soon as the accumulator pressure has reached a level matching the piston load, further actuation of the pump will cause hydraulic fluid to be supplied to the cylinder 10 via supply conduit 11, flow valve 17 and check valve 16. The supply pressure will simultaneously act on the largest (at the left) and the smallest (at the right) surface of the differential spool 22. As a result, the spool 22 will be moved to the right and the check valve 23 will be mechanically pushed into its opened position. This will cause an open connection between the accumulator and the hydraulic cylinder, which open connection will be maintained for a short time upon each pressure stroke, during which time a certain amount of fluid is permitted to flow from the accumulator to the cylinder thereby avoiding shocks.

At the same time, the pressure in the pilot control conduit 24 will, with a certain delay, increase to a level corresponding to that in the supply and branch conduits 11, 14 so that the complete spool will become subjected to the same system pressure. The check valve 23 will thereby close under the action of its return spring and the accumulator pressure. This situation will countinue until, at a following pressure stroke, the pressure in the supply conduit 11 and the branch conduit 14 will temporarily increase to a level above the system pressure, as a result of which the spool 22 and the valve 23 will be temporarily kept open.

Assume now that the bed, or other load, is at a desired stationary position but that there is a decrease in the piston load caused by, for example, the patient being moved from the support section to an operating table. This decrease in piston load will not result in any undesired movement of the support section because the check valve 23 will be kept closed so that no supply of liquid from the accumulator 15 can take place. Such additional supply of liquid from the accumulator will take place only if it is desired, viz. as soon as a next pressure stroke of the pump is being carried out. Initiating a next pressure stroke will cause the pressure in the supply and branch conduits 11, 14 to increase above the level of the decreased system pressure, so that the spool 22 will be no longer in balance and will move to the right permitting fluid flow from the accumulator 15 towards the cylinder 10.

When the level of the patient support section is to be lowered, actuation of the relief valve 20 will cause an immediate pressure drop to take place in the pilot control conduit 24, while the system pressure under the piston will slightly decrease. As a result of this the differential spool will be pushed to the right, thereby tending to cause the valve 23 to open, so that liquid from the accumulator 15 may flow to the cylinder 10. This situation, however, will be of a very short duration because, after a slight delay, the decreased system pressure will rule in the branch and pilot control conduits 14, 14', as well as in the pilot control conduit 24, which brings the differential spool 22 in to balance again and causes the valve 23 and thereby the accumulator to close.

When the patient support section is lowered into its lowermost position (defined by a mechanical stop) the system pressure will drop to zero. However, the differential spool will remain in balance and the valve 23 will be kept closed so that the accumulator will not completely discharge.

We claim:

1. In a hydraulic actuating unit having a reservoir for hydraulic fluid, a hydraulic piston cylinder device the cylinder of which has its end connected to the reservoir through a supply conduit and a return conduit, the supply conduit containing a hydraulic pump, a branch conduit leading to a hydraulic liquid accumulator and connected to the supply conduit between the pump and the cylinder, a combination therewith of:

a multiple pilot operated check valve of the differential type disposed in the branch conduit towards the accumulator, the check valve including a differential spool member the largest and smallest end faces of which are subject to the pressure in the branch conduit and the differential area of the spool member being subject to the pressure in a conduit leading from the return conduit, whereby the pressure in the branch conduit to the accumulator tends to cause the check valve to open while the pressure in the return conduit tends to move the spool member and the check valve into a closed position.

2. In a hydraulic actuating unit for raising a load, and having a reservoir for hydraulic fluid, a hydraulic piston cylinder device the cylinder of which has its end connected to the reservoir through a supply conduit and a return conduit, said supply conduit containing a hydraulic plunger pump with suction and pressure valve means and said return conduit containing an orifice and a normally closed relief valve, a branch conduit leading to a hydraulic liquid accumulator and connected to the supply conduit at a location between the cylinder and the pressure valve means, a check valve in the supply conduit at a location between the branch conduit and the cylinder, a pressure dependent orifice disposed between the check valve and the branch conduit to the accumulator, the improvement wherein:

a multiple pilot operated check valve of the differential type is disposed in the branch conduit toward the accumulator, the check valve has a differential spool member the largest and smallest end faces of which are subject to the pressure in the branch conduit while the differential area of the spool member is subject to the pressure in a second branch conduit leading from the return conduit at a location between the orifice and the relief valve, whereby the pressure in the branch conduit to the accumulator tends to cause the spool member and thereby the check valve to open, whereas the pressure in the second branch conduit tends to move the spool member and valve into the closed position.

3. An actuating unit according to claim 2, characterized in that the hydraulic piston cylinder device, the reservoir and the accumulator are built together into a compact unit, making use of a common base portion, in which the various valves and conduits are provided.

* * * * *